US005417275A

United States Patent [19]

Vallejo

[11] Patent Number: 5,417,275

[45] Date of Patent: May 23, 1995

[54] AIR CIRCULATOR CONTROL APPARATUS AND METHOD

[76] Inventor: Ray Vallejo, 1716 Warwick, Houston, Tex. 77093

[21] Appl. No.: 89,019

[22] Filed: Jul. 9, 1993

[51] Int. Cl.[6] ..... F25B 29/00

[52] U.S. Cl. ..... 165/2; 62/411; 165/16; 165/48.1; 165/59; 236/49.1

[58] Field of Search ..... 165/1, 2, 14, 16, 27, 165/30, 32, 39, 40, 48.1, 59; 62/411, 428; 236/49.1

[56] References Cited

U.S. PATENT DOCUMENTS

| | | | |
|---|---|---|---|
| 2,224,878 | 12/1940 | Morrison | 62/411 |
| 2,892,324 | 6/1959 | Quick | 165/16 |
| 3,949,809 | 4/1976 | Gilles | 165/48.1 |
| 4,126,269 | 11/1978 | Bruges | 236/49 |
| 4,373,576 | 2/1983 | Strupczewski | 165/48.1 |
| 4,526,227 | 7/1985 | Baker | 165/48.1 |
| 4,779,671 | 10/1988 | Dolison | 165/16 |

*Primary Examiner*—Ira S. Lazarus
*Assistant Examiner*—Daniel J. O'Connor
*Attorney, Agent, or Firm*—Alton W. Payne

[57] ABSTRACT

An air circulator control apparatus and method of use for at least one air circulator and a climate control system having a heater and a cooler to regulate the air temperature of a vertical column of air in a structure. The present invention seeks to overcome the negative effects of naturally occurring convection currents and improper placement of air outlets resulting in distinct zones of warm and cool air in structures. The air circulator control apparatus temporarily delays activation of at least one air circulator when used with the heater, to provide for an accumulation of warm air at or near at least one air circulator, before allowing at least one air circulator to be activated. In this manner, generally warm air is circulated in the absence of creating undesirable drafts and wind chills. The air circulator control apparatus instantly activates at least one air circulator when used with the cooler to generally circulate cool air. The air circulator control apparatus temporarily sustains energy supplied to at least one air circulator after the climate control system has been deactivated, thus circulating air for a relatively short period of time to continue regulating the air temperature of the vertical column of air within the structure and to reclaim all accumulated heat at the ceiling line.

13 Claims, 3 Drawing Sheets

AIR CIRCULATOR CONTROL APPARATUS AND METHOD

FIELD OF THE INVENTION

An air circulator control apparatus and method for activating and deactivating one or more air circulators to regulate the air temperature of a vertical air column within a structure in a draft-free and wind chill-free manner. Specifically, an air circulator control apparatus and method to selectively activate and deactivate one or more air circulators to regulate the air temperature of a vertical air column within the structure in a draft-free and wind chill-free manner, wherein the air circulator control device is delayedly engaged in response to the ignition of a climate control system and delayedly disengaged after the climate control system has terminated operation.

BACKGROUND OF THE INVENTION

Improved air circulation for more efficient heating and cooling of air columns within structures is of great importance since a majority of homes, businesses and manufacturing facilities are now climate controlled. Conventional heating and cooling produces naturally occurring convection currents, which are largely responsible for the inefficiency and increased expense of heating and cooling of structures. Convection currents require the climate control system to overproduce conditioned air to maintain comfortable temperatures. As the costs for energy continue to increase, our energy resources must be used more efficiently. Therefore, better and more efficient means must be implemented to regulate the air temperature of vertical air columns in structures.

The effects caused by convection currents result in warm air rising and collecting near the upper portion of a structure and cool air falling and collecting near the floor of the structure, yielding two distinct areas of divergent air temperature. Convection currents become especially problematic during the cooler months when the heater of the climate control system is activated and must over produce sufficient warm air to offset the convection current effect and raise the air temperature near the floor of the structure. Similarly, during warmer months, the cooler must also over produce sufficient cool air to offset the convection current effect to maintain a comfortable air column temperature within the structure.

It is not unusual that the air temperature at or near the ceiling of a structure can be as much as 25° F. higher than the air temperature at the floor. The improper placement of air outlets in structures, further taxes already overworked climate control systems. The conventional heating and cooling of commercial, industrial and residential structures results in inefficient and increased consumption of energy, increased energy costs, inefficient use of heating and cooling equipment and excessive wear on the climate control system and related equipment. Such inefficiencies and excessive wear cream the potential for premature equipment failure.

Climate control systems will operate most efficiently when the air outlets in structures are properly positioned and air movement within an air column is regulated to offset the effects created by convection currents. Normally, the improper placement of air outlets within structures is quite burdensome to remedy. However, regulating the air movement is relatively easy and adequately overcomes the effects caused by improper placement of air outlets and convection currents. Further, the circulation of warm air during cool periods and the circulation of cool air during warm periods, is substantially less inexpensive as compared to conventional heating and cooling costs associated with the over production of conditioned air to maintain a comfortable climate.

Additionally, while prior art devices such as Dolison, U.S. Pat. No. 4,779,671 circulate air, they do not reclaim heat in a draft-free and wind chill-free manner as does the present invention. The device in Dolision comprises a cooling, heating and ventilation system having ceiling fans 24 in operative association with a plurality of thermostats 64, 70, 78. The ignition of one or more ceiling fans 24 in the Dolison device is not dependent upon the ignition of the climate control system, as in the present invention, but upon the readings of the various thermostats 64, 70, 78. In the heating mode of the Dolison device, when a drop in air temperature is detected by the operative thermostat 78, which is placed at eye level, one or more ceiling fans 24, automatically become activated. Unfortunately, the one and only thermostat 78 which controls the ceiling fans 24 in the heat mode, only detects the air temperature at eye level and can not detect the air temperature at or near the ceiling fans and more importantly, can not detect whether warm air has accumulated at or near one or more ceiling fans. Therefore, activation of the ceiling fans in the Dolison device, creates undesirable drafts and wind chills while circulating air in the heat mode. The present invention seeks to avoid these drafts and wind chills by only operating air circulators in the heat mode, after an accumulation of heated air collects at or near the air circulators. Warm air can only be reclaimed if it is present and accurately detected. By activating air circulators in response to readings of thermostats placed adjacent to the air circulators or delayedly activating air circulators in response to the ignition of the climate control system and only engaging said air circulators after an accumulation of warm air has collected at or near the air circulators, can the movement of warm air be accomplished in a draft-free and wind chill-free manner. These problems are overcome in the present invention by automatically cycling air circulators in relatively short repetitious cycles using time delays for making and breaking the heating circuits.

Therefore, a need exists for an air circulator control apparatus and method for use with one or more air circulators and a climate control system to more efficiently regulate the air temperature of a vertical column of air in a structure, in a draft-free and wind chill-free manner.

It is, therefore, a feature of the present invention is to provide an air circulation control apparatus which during cool periods reclaims warm air at or near the ceiling and during warm periods moves cool air for better forced convection and greater heat removal, despite improper positioning of the air outlets.

Yet another feature of the present invention is to provide an air circulation control apparatus for overcoming the adverse results of convection currents and improper placement of air outlets in structures.

Another feature of the present invention is to provide an air circulator control apparatus and method for regulating the air temperature of a vertical air column within a structure in an energy efficient manner to achieve vertical air temperature regulation at a minimum of expense.

Another feature of the present invention is to provide an air circulator control apparatus for selectively activating and deactivating one or more air circulators to regulate the temperature of a vertical air column of a structure.

Another feature of the present invention is to provide an air circulator control apparatus, for delayedly activating and delayedly deactivating one or more air circulators in a structure to regulate the air temperature of a vertical air column within a structure.

Another feature of the present invention is to provide an air circulator control apparatus, for delayedly activating and deactivating one or more air circulators in a structure to regulate the vertical air temperature of a vertical air column within a structure without creating drafts and wind chills.

Still another feature of the present invention is to provide an air circulator control apparatus to increase the efficiency of a climate control system during heating and cooling operations.

Yet another feature of the present invention is to provide an air circulator control apparatus and method to reduce the costs of operating a climate control system within a structure.

Still another feature of the present invention is to reclaim the heated air at or near the ceiling of a structure which may be dissipated into the attic or space above the ceiling.

Still another feature of the present invention is to provide an air circulator control apparatus which delayedly activates one or more air circulators after an accumulation of heated air has been collected at or near the ceiling of a structure.

Another feature of the present invention is to provide an air circulator control apparatus which continues to engage at least one air circulator within a structure for a relatively short period of time after the deactivation of the climate control system.

Still another feature of the present invention is to provide an air circulator control apparatus which moves cool air for better circulation and heat removal within a structure simultaneously with the ignition of the climate control system.

Another feature of the present invention is to provide an air circulator control apparatus that is compatible with existing wall switches for easily retro-fitting with said wall switch boxes.

SUMMARY OF THE INVENTION

The present invention provides an air circulator control apparatus and method which is generally used with one or more air circulators and a climate control system having a heater, a cooler and a blower, to regulate the air temperature of a vertical column of air in a structure. Delayed activation of the air circulator control apparatus of the present invention is dependent upon the ignition of a heater and is not dependent upon ignition of the blower. Moreover, the present invention is designed to be used with air circulators separate and apart from the blowers of well known climate control systems and is intended for use with, for example, ceiling fans, floor fans, exhaust fans, ventilator fans and the like. The apparatus of the present invention is a circuit which includes a means for receiving and processing a signal generated by the ignition of the heater or cooler of the climate control system and in response thereto, delayedly engaging or instantaneously engaging one or more air circulators to regulate the temperature of a vertical air column in a structure and a means for sustaining said one or more air circulators a selectively variable period of time after the deactivation of the climate control system. The method for using the air circulation control apparatus includes detecting an accumulation of conditioned air at or near the air circulators and circulating the conditioned air to efficiently regulate the air temperature of vertical column of air within a structure, in the absence of producing drafts and wind chills during cool weather.

In the preferred embodiment, the means for receiving one or more signals generated from the climate control system includes a first "common" wire, a second "heater" wire and a third "cooler" wire. The heater wire provides a communication link from the heater of the climate control system to the circuit and similarly, the cooler wire provides a communication link from the cooler of the climate control system to the circuit. The common wire provides electrical grounding for the circuit.

The means for processing one or more signals generated from the climate control system includes a first switch, preferably being a time delay relay switch in operative association with a first coil and a second switch, preferably being a non-delay relay switch in operative association with a second coil. The first switch is additionally engaged to the heater and the second switch is engaged to the cooler, to receive respective ignition signals. The first switch and the second switch are simultaneously engaged with a first source of electrical energy. A second source of electrical energy, being opposed to the first source of electrical energy, is in constant contact with one or more air circulators, such that when the first source of energy successfully completes the circuit and is permitted to engage one or more air circulators, said air circulators will become activated. When the heater becomes engaged a signal is generated and said signal is received by the first switch. The first switch detects the signal and triggers the first coil to temporarily delay conveyance of the first source of electrical energy to a third switch. The temporary delay of the first switch is easily adjusted by the user for a selectively variable time period, for example 4–6 minutes. The time delay produced by the first switch and first coil allows a sufficient amount of warm air to accumulate at one or more air circulators, so that preferably only warm air will be circulated by one or more air circulators, thus obviating undesirable drafts and wind chills. Similarly, when the cooler becomes engaged, a signal is generated and said signal is received by the second switch which instantly conveys the first source of electrical energy to the third switch.

The third switch is preferably a 3-way switch having an "automatic," "continuous," and "off" setting. The automatic setting, during the heating mode, selectively conveys and interrupts conveyance of the first source of electrical energy to a fourth switch in response to the temporary delay produced by first switch and first coil to provide that one or more air circulators circulate only warm air to regulate the air temperature of a vertical column of air within a structure. During the cooling mode, the automatic setting instantly conveys the first source of current to the fourth switch to provide that one or more air circulators immediately circulate air. The automatic setting also provides for the delayed deactivation of one or more air circulators after the climate control system has terminated operation. The continuous setting continuously conveys the first source of electrical energy to the fourth switch, and is in operative association with the second switch to provide that one or more air circulators circulate air to regulate the air temperature of a column of air in a structure, regardless of whether the climate control system is operating. The off setting disconnects the first source of energy from the fourth switch and prevents engagement of one or more air circulators with the first source of current through the circuit of the present invention.

The fourth switch is preferably an "on/off" switch having variable current conveyance capabilities. When the fourth switch is in the on position, the first source of current will successfully complete the circuit and preferably engage one or more air circulators, thereby activating one or more air circulators. The on position is selectively variable to restrict or enhance the flow of the first source of current through the fourth switch. Increasing the flow of the first source of current through the fourth switch, increases the revolutions per minute of one or more air circulators and, likewise, decreasing the flow of the first source of energy through the fourth switch, decreases the revolutions per minute of one or more air circulators. When the fourth switch is in the off position, the first source of current will be prevented from engaging one or more air circulators through the circuit of the present invention.

Once the conventional climate control system has initiated operation, causing one or more air circulators to become activated, the climate control system will operate until the room temperature at the thermostat reaches a desired temperature, then the climate control system will deactivate. However, one or more air circulators will continue to circulate air for a predetermined period of time after the climate control system has become deactivated, in an effort to regulate the air temperature of a vertical column of air within the structure and importantly, to continue to reclaim all accumulated heat at the ceiling line. The time period for post-operation of one or more air circulators after the climate control system is deactivated, is easily varied by the user, according to the particular time interval desired.

DESCRIPTION OF THE PREFERRED EMBODIMENTS

Reference will now be made in detail to the present preferred embodiments of the invention as described in the accompanying drawings.

Figure 1:
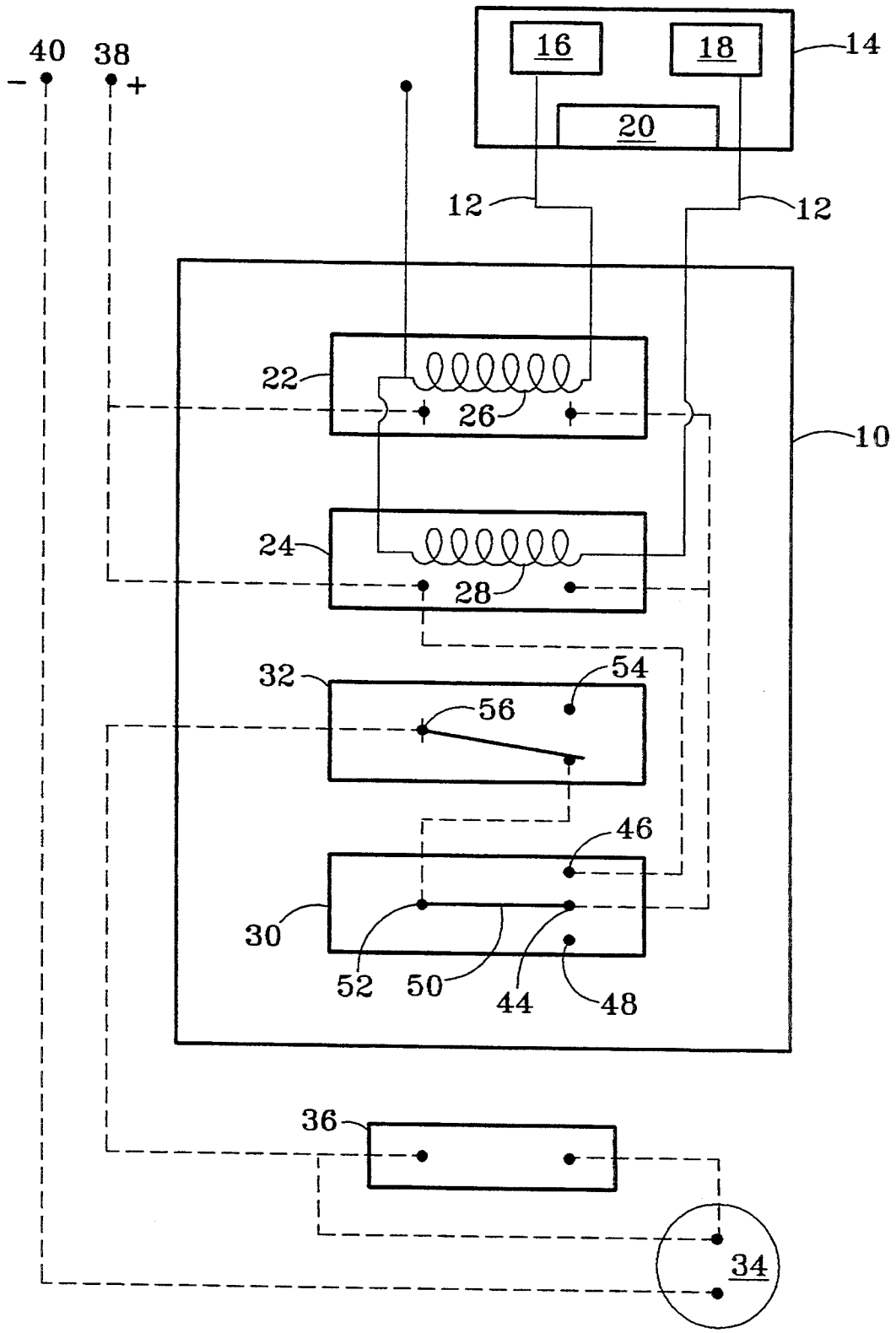
FIG. 1 is a schematic diagram of FIG. 1 illustrating the preferred embodiment circuit of the present invention.
Figure 2:
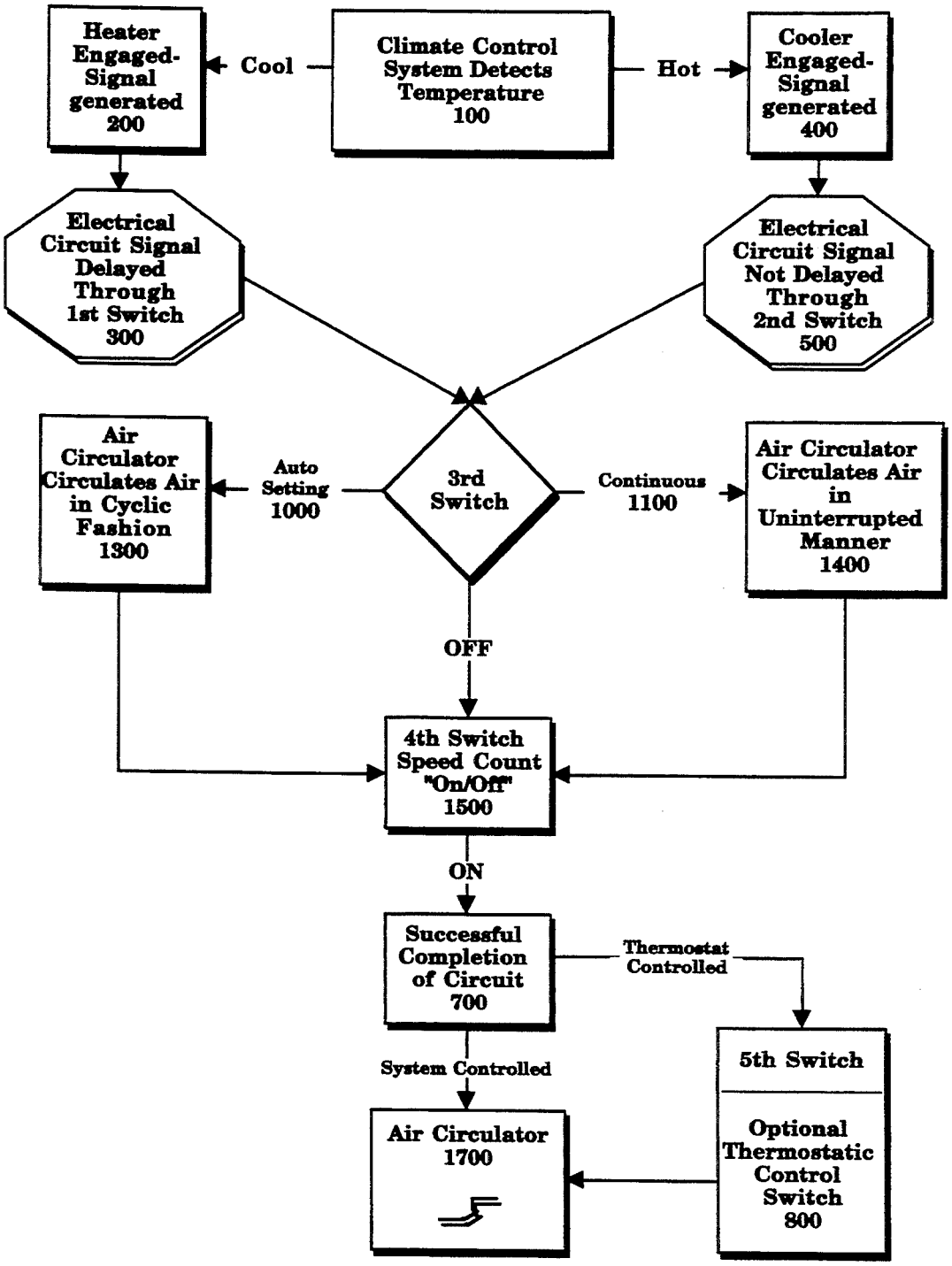
FIG. 2 is a block diagram illustrating the operation of the preferred embodiment of the invention in FIG. 1.

FIG. 1 is a schematic of a circuit 10 as practiced by the present invention. FIG. 2 is a block diagram illustrating the operation and method of using the present invention. As illustrated in FIG. 1 the circuit 10 has seven primary components. The circuit 10 includes a signal receiving means 12 for receiving a signal generated from a climate control system 14, wherein the climate control system 14 comprises a heater 16, a cooler 18 and a blower 20 for propelling conditioned air into a structure (not shown). The circuit 10 further includes a first switch 22, preferably a time delay relay switch, for use with the heater 16 and a second switch 24, preferably a non-delay relay switch, for use with the cooler 18. A first coil 26 engages the first switch 22 and a second coil 28 engages the second relay switch 24. The first coil 26 performs two or more functions by first, receiving a signal generated by the heater 16 and temporarily delaying the transmission of current through the first switch 22 and secondly, sustaining the first source of current 38 transmitted through the first switch 22 a relatively short pre-determined period of time after the heater 16 has terminated operation and the signal has similarly been terminated. The second coil 28 preferably does not delay the transmission of current 38 transmitted through the second switch 24 but similar to the first coil 26, serves to sustain the current 38 transmitted through the second switch 24, a short pre-determined amount of time once the cooler 18 has terminated operation and stopped generating the signal. Simply stated, the first coil 26 delays the "making" of the first switch 22 and both the first coil 26 and the second coil 28 delay the respective "breaking" of the first switch 22 and the second switch 24. A third switch 30, preferably a three-way switch, receives the signal generated from the climate control system 14 and selectively conveys the signal to a fourth switch 32, preferably a variable on/off switch, for controlling the revolutions per minute of one or more air circulators 34. In the preferred embodiment, one or more air circulators 34 might include, for example a conventional ceiling fan, a floor fan, an exhaust fan or any other air mover means generally found within a structure, separate and apart from conventional climate control systems. When the circuit 10 is completed a first source of current 38, which simultaneously enters the first switch 22 and second switch 24, is joined with an opposing second source of current 40 to activate one or more air circulators 34 to circulate air to regulate the air temperature of a vertical column of air in a structure (not shown) in a draft-free and wind chill-free manner and to reclaim an accumulation of heated air at the ceiling line (not shown) of said structure. A fifth switch 36, having thermostatic control capabilities, may be located between the circuit 10 and one or more air circulators 34 to selectively convey the first source of current 38 to one or more air circulators 34 when the air temperature at one or more air circulators 34 falls within a predetermined range, for example 81°–84° F. By way of example, when the fifth switch 36 is employed, the air temperature at the fifth switch 36 is monitored and should the air temperature be greater than or equal to 84° F., the fifth switch 36 will close causing one or more air circulators 34 to become activated and when the air temperature falls to 81° F. or less, the fifth switch 36 will open thereby disengaging one or more air circulators 34. In this manner, only warm air will be circulated in a draft free, wind chill-free manner. An alternate embodiment of the present invention provides that one or more air circulators 34, once engaged in response to the ignition of the climate control system 14, remain operational until a desired temperature is detected at or near one or more air circulators 34, at which time one or more air circulators 34 will be deactivated.

Referring now to FIG. 1 and FIG. 2, the operation of the present invention will be discussed. As illustrated in step 100 of FIG. 2, the room temperature must first be detected by the climate control system 14 to selectively activate the heater 16 or the cooler 18. Activation of the heater 16 preferably occurs when cool exterior temperatures are detected and activation of the cooler 18 preferably occurs when warm exterior temperatures are detected. As practiced in known climate control systems 14, selective engagement of either the heater 16 or the cooler 18 activates the blower 20 to propel selectively heated and cooled air into the interior of the structure (not shown). Activation of the heater 16 generates a first signal, as depicted in step 200, which is sent to the first switch 22, illustrated at step 300. Activation of the cooler 18 generates a second signal, as noted in step 400, which is sent to the second switch 24, illustrated at step 500. The first switch 22 and the second switch 24 are contemporaneously engaged to the first source of current 38. One or more air circulators 34 are in direct contact with the opposing second source of current 40, shown at step 600. When employing the fifth switch 36 at step 800 and the first source of current 38 successfully completes the circuit 10, as noted at step 700, one or more air circulators 34 will be activated to circulate conditioned air to regulate the air temperature of a vertical column of air in a structure (not shown). When the fifth switch 36 is not employed and the first source of current 38 successfully completes the circuit 10, as shown at step 700, the first source of current 38 will flow to one or more air circulators 34, as shown at step 1700.

The first source of current 38 is temporarily delayed, as noted in step 300, from flowing through the first switch 22. The first coil 26 in conjunction with the first switch 22 temporarily delays the first source of current 38 from engaging the first contact 42 of the first switch 22 and thus temporarily prevents the completion of the first switch 22 by, for example 4–6 minutes. Once the time delay of the first switch 22 has expired, the first source of current 38 is permitted to flow through the first switch 22 to be received by the third switch 30, as described by step 900. The temporary delay produced by the first switch 22, provides the heater 16 a sufficient quantity of time to produce a necessary volume of warm air at one or more air circulators 34, such that when said one or more air circulators 34 becomes engaged, preferably only warm air will be circulated thus avoiding any undesirable drafts and wind chills. The length of the temporary delay for the first switch 22, in passing the signal from the heater 16, is easily varied by the user. The second switch 24 instantaneously transmits the first source of current 38 to the third switch 30, when the cooler 18 is engaged, as followed in step 500.

The third switch 30, illustrated at step 900, preferably includes at least three settings, including an "automatic" setting, representing step 1000; a "continuous" setting, representing step 1100; and a disengaged or "off" setting, representing step 1200. The particular setting selection of the third switch 30, selected by the user, determines whether one or more air circulators 34 will move air "automatically," as noted by step 1000, or "continuously," as noted by step 1100, or not at all, as noted by step 1200. For example, the "automatic" setting of the third switch 30 is generally used when one or more air circulators 34 are activated and deactivated only in response to the ignition of the climate control system 14 as depicted in step 1300. The "continuous" setting of the third switch 30 is actually a bypass for "automatic" activation of one or more air circulators 34 to circulate air in an uninterrupted manner, regardless of whether the climate control system 14 is operative or not, as illustrated in step 1400. When the third switch 30 is in the "off" position, noted by step 1200, one or more air circulators 34 will become immediately disengaged and there will be no circulation of air by one or more air circulators 34.

The third switch 30, illustrated in FIG. 1, preferably includes a first contact 44 representing the "automatic" setting, referred to by step 1000; a second contact 46 representing the "continuous" setting, referred to by step 1100; and a third contact 48 representing the "off" setting, referred to by step 1200. A contact gate 50 pivots from a pivoting fourth contact 52 to selectively engage the first contact 44 and the second contact 46 and the third contact 48, wherein the first source of current 38 may be selectively transferred from the first contact 44 and the second contact 46 to a first contact 54 of the fourth switch 32. The third switch 30 may selectively prevent the first source of current 38 from advancing to the fourth switch 32 wherein the fourth contact 52 engages the third contact 48 to disengage the third switch 30 from the fourth switch 32.

The fourth switch 32, preferably includes the first contact 54 and a second contact 56, wherein closure between the first contact 54 and the second contact 56 allows the first source of current 38 to selectively engage one or more air circulators 34, represented in step 1700 and the fifth switch 36, represented in step 800 of FIG. 2. The fourth switch 32, illustrated as step 1500 in FIG. 2, is preferably an "on/off" switch having variable current flow capabilities, wherein successful completion of the circuit 10, represented in step 700 provides a variable first source of current 38 to selectively energize one or more air circulators 34 to increase and decrease the revolutions per minute of at least one air circulator 34. The greater the flow of the first source of current 38 permitted to pass through the speed control switch 32, the greater the revolutions per minute of one or more air circulators 34. Similarly, when the flow of the first source of current 38 is reduced through the speed control switch 32, the revolutions per minute of one or more air circulators 34 comparatively decreases. When the speed control switch 32 is in the "off" position, as noted by step 1600, the first contact 54 is not engaged to the second contact 56 and the fourth switch 32 is open, wherein the first source of current 38 will not flow to one or more air circulators 34.

As illustrated at step 1700, when one or more air circulators 34 are simultaneously engaged to the oppositely charged second source of current 40 and the first source of current 38, one or more air circulators 34 will become energized to circulate air to regulate the air temperature of a vertical column of air within the structure (not shown).

After becoming energized as a result of the ignition of the heater 16, one or more air circulators 34 will circulate warm air in a draft-free and wind chill-free manner, during the time period that the heater 16 is engaged. After the heater 16 has become disengaged, the rotation of one or more air circulators 34 will continue for a relatively short period of time, to continue regulating the air temperature of a vertical air column in a structure (not shown) in a draft-free and wind chill-free manner. The first holding coil 26 detects the termination of the heater 16 and sustains the first source of current 38 through the circuit 10 to provide the first source of current 38 to one or more air circulators 34 for a predetermined period, for example 4–6 minutes.

Activation of the cooler 18 instantly engages one or more air circulators 34 causing cool air to be immediately circulated. Cool air circulation by one or more air circulators 34 will similarly continue during the period that the cooler 18 is activated. The second holding coil 28 detects the deactivation of the cooler 18 and in response to said deactivation, sustains the first source of current 38 through the circuit 10 and energizes one or more air circulators 34 for a relatively short period of time, for example 4–6 minutes, after the cooler 18 becomes deactivated, to continue regulating the air temperature of the vertical air column of air within the structure (not shown).

Figure 3:
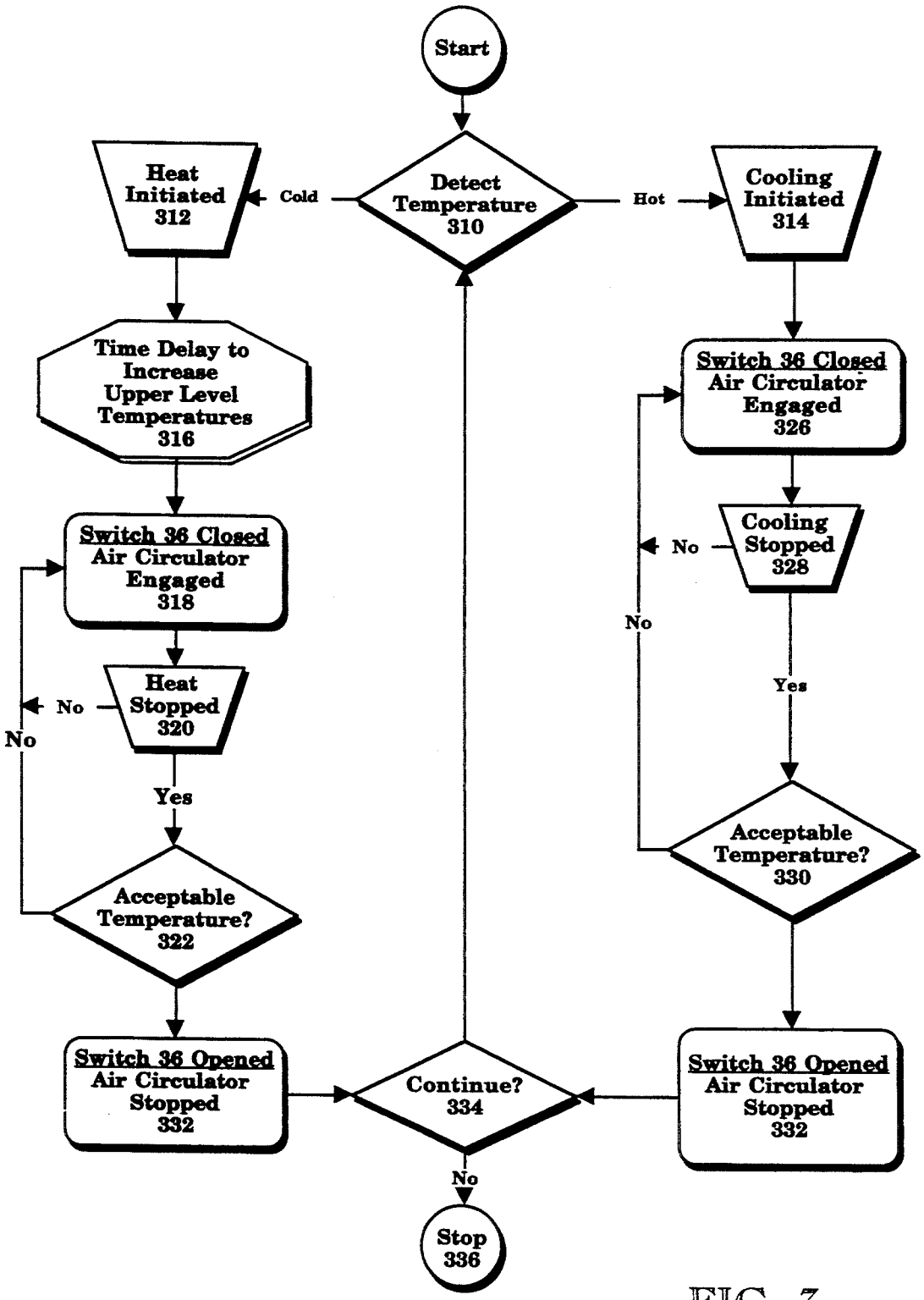
FIG. 3 is an alternate embodiment of the invention in FIG. 1 illustrating a temperature dependent air circulator disconnection means.

FIG. 3 is an alternate embodiment of the present invention, wherein one or more air circulators 34 are engaged and disengaged based on the fifth switch 36 becoming selectively closed and opened in response to the detection of specific air temperatures adjacent said one or more air circulators 34. Reference will now be made to FIG. 1 and FIG. 3. The climate control system 14, shown at step 310, detects the temperature in the structure (not shown) and in response, activates the heater 16, illustrated at step 312, if a cool temperature is detected and activates the cooler, illustrated at step 314, if a warm temperature is detected. As described above, if the heater 16 is engaged, one or more air circulators 34 will be delayed, shown at step 316, to allow a sufficient quantity of warm air to accumulate at one or more air circulators 34. When the temporary time delay of the first switch 22 and first coil 26 has expired, illustrated at step 316, one or more air circulators 34 engages, as depicted at step 318. One or more air circulators 34 will operate continuously until the heater 16 terminates, as described in step 320. Once the heater 16 has terminated operation, one or more air circulators 34 will continue to operate for a few minutes preferably to reclaim all available warm air, as illustrated at step 322, until the temperature at said one or more air circulators 34 has reached an acceptable temperature. When an acceptable air temperature is detected at the fifth switch 36, one or more air circulators 34 will become deactivated.

When the cooler 18 is initiated, as depicted at step 314, one or more air circulators 34 are instantly engaged, as shown at step 326. One or more air circulators will circulate cool air during the operation of the cooler 18, as described at step 328. Once the cooler 18 has become disengaged, one or more air circulators 34 will continue to operate, as shown at step 330, until an acceptable temperature has been detected at one or more air circulators 34. Once an acceptable air temperature has been detected at one or more air circulators 34, one or more air circulators 34 will become disengaged, as illustrated at step 332. When one or more air circulators 34 become disengaged, control over the circuit 10 will be selectively returned to the climate control system 14, at step 310 for future initiation or the circuit 10 will become disengaged, at step 336, as illustrated at step 334.

It will be appreciated that this or other air circulator control devices within the purview of the present invention can be provided to regulate the air temperature of a vertical column of air within a structure to improve the efficiency of the heating of said structure, without producing undesirable drafts and wind chills. Additional air circulation control devices and various modifications of the techniques, procedures, material and equipment, will be apparent to those in the art. It is intended that all such variations within the scope and spirit of the appended claims be embraced thereby.

What is claimed is:

1. An air circulator control apparatus for use with at least one air circulator and a climate control system having a heater and a cooler, to regulate the temperature of a vertical column of air in a structure, comprising:

a circuit for one of delayedly engaging and instantly engaging selectively at least one air circulator in response to the ignition of the climate control system;

a means within said circuit for delayedly engaging at least one air circulator after the activation of the heater;

a means within said circuit for instantly engaging at least one air circulator upon the activation of the cooler; and a means within said circuit for sustaining at least one air circulator for a selectively variable period of time after one of the heater and cooler selectively have become disengaged, wherein the sustaining of at least one air circulator after the termination of the heater reclaims an accumulation of heated air at the ceiling line and circulates said air in a draft-free and wind chill-free manner.

2. The air circulator control apparatus as described in claim 1, further comprising:

a first source of current in electrical communication with said circuit; and a second opposing source of current in electrical communication with at least one air circulator, wherein the successful passage of the first source of current through said circuit energizes at least one air circulator.

3. The air circulator control apparatus as described in claim 2, wherein the circuit comprises:

a means for receiving at least one signal generated from the heater;

a means for receiving at least one signal generated from the cooler;

a first switch, for receiving at least one signal generated from the heater and in response temporarily delaying the conveyance of the first source of current to temporarily delay activation of at least one air circulator;

a first coil, to facilitate the first switch in temporarily delaying the conveyance of the first source of current and for temporarily sustaining the first source of current supplied through the first switch when the heater is deactivated;

a second switch, for receiving at least one signal generated from the cooler and simultaneously conveying the first source of current;

a second coil, to facilitate the second switch in temporarily sustaining the first source of current supplied through the second relay switch to at least one air circulator when the cooling unit is deactivated;

a third switch for receiving the first source of current from the first switch and receiving the first source of current from the second switch and in response thereto, selectively conveying said first source of current through one of an automatic manner and a continuous manner and to prevent the first source of current from passing through said third switch; and a fourth switch for receiving the first source of current from the third switch and in response thereto, selectively engaging at least one air circulator to rotate said at least one air circulator at a variable speed and disengaging at least one air circulator.

4. An air circulator control apparatus as recited in claim 3, wherein the first switch delayedly engages at least one air circulator after the ignition of the heater, such that at least one air circulator engages only after a quantity of warm air has accumulated adjacent at least one air circulator.

5. An air circulator control apparatus as recited in claim 4, wherein the first switch delayedly engages at least one air circulator to circulate warm air in a draft-free and wind chill-free manner.

6. An air circulator control apparatus as recited in claim 3, wherein the first coil and the second coil sustain the first source of current supplied to at least one air circulator for a selectively variable period of time after the climate control system is deactivated to regulate the air temperature of a vertical column of air in the structure in a draft-free and wind chill-free manner.

7. An air circulator control apparatus for use with at least one air circulator and a climate control system to regulate the temperature of a vertical column of air in the structure as recited in claim 1, wherein the means for delayedly engaging at least one air circulator after the activation of the heater, comprises:

a time delay relay switch in electrical communication with the heater and a source of energy; and a first holding coil to temporarily delay passage of the source of energy to at least one air circulator.

8. An air circulator control apparatus for use with at least one air circulator and a climate control system to regulate the temperature of a vertical column of air in the structure as recited in claim 1, wherein the means for instantly engaging at least one air circulator upon the activation of the cooler, comprises:

a second relay switch in electrical communication with the cooler and a source of electrical energy, wherein the source of electrical energy flows undisturbed through the second relay switch.

9. An air circulator control apparatus for use with at least one air circulator and a climate control system to regulate the temperature of a vertical column of air in a structure as recited in claim 1, wherein the means for sustaining at least one air circulator for a selectively variable period of time after the climate control system has become disengaged, comprises:

a first holding coil in operative association with a first time delay relay switch; and a second holding coil in operative association with a second relay switch.

10. An air circulation control apparatus for use with at least one air circulator and a climate control system to regulate the temperature of a vertical column of air in a structure as recited in claim 1, wherein the means for varying the revolutions per minute of at least one air circulator, comprises:

an on/off switch, providing a selectively variable current to at least one air circulator, wherein reducing the current transmitted through said on/off switch reduces the revolutions per minute of at least one air circulator and increasing the current transmitted through said on/off switch increases the revolutions per minute of at least one air circulator.

11. A method for regulating the temperature of an air column for maintaining a comfortable air temperature in a structure exposed to a cool environment, comprising the steps of:

(a) detecting the temperature of at least one location within the structure;

(b) activating a heater to produce warm air in response to the detection of a cool temperature within the structure;

(c) accumulating a sufficient quantity of warm air adjacent at least one air circulator;

(d) after a sufficient quantity of warm air has been accumulated adjacent at least one air circulator, engaging at least one air circulator to circulate the warm air throughout the room, thereby regulating the air temperature of a vertical air column within the structure;

(e) sustaining at least one air circulator for a selectively variable time period after the heater has been disengaged, to continue regulating the air temperature of a vertical air column within the structure; and (f) disengaging at least one air circulator after the selectively variable time period has lapsed to reduce the incidence of producing an undesirable draft.

12. A method for regulating the temperature of an air column for maintaining a comfortable air temperature in a structure exposed to a warm environment, comprising the steps of:

(a) detecting the temperature of at least one location within the structure;

(b) activating a cooler to produce cool air in response to the detection of a warm temperature within the structure;

(c) engaging at least one air circulator to circulate the cool air throughout the room, thereby regulating the air temperature of a vertical air column within the structure;

(d) sustaining at least one air circulator for a selectively variable time period after the cooler has been disengaged, to continue regulating the air temperature of a vertical air column within the structure; and (e) disengaging at least one air circulator after the selectively variable time period has lapsed.

13. A method for engaging at least one air circulator to regulate the vertical air temperature of a column of air within a structure in response to the ignition of a climate control system, comprising the steps of:

activating a climate control system having a heater and a cooler;

selectively producing a signal from the heater and the cooler;

selectively differentiating between the signal generated from the heater and the cooler;

delaying temporarily the activation of at least one air circulator in response to the signal generated from the heater, to circulate warm air in a draft-free and wind chill-free manner;

engaging at least one air circulator instantly, in response to the signal generated from the cooler, to circulate cool air;

regulating the revolutions per minute of at least one air circulator; and sustaining temporarily at least one air circulator to selectively circulate warm air and cool air for a selectively variable period of time after the climate control system has been disengaged.

* * * * *